US005609531A

United States Patent [19]

Gates

[11] Patent Number: 5,609,531

[45] Date of Patent: Mar. 11, 1997

[54] GOLF TRAINING APPARATUS

[76] Inventor: Elliot C. Gates, 2485 Bounty St. SE., Prior Lake, Minn. 55372

[21] Appl. No.: 465,408

[22] Filed: Jun. 5, 1995

[51] Int. Cl.[6] ..... A63B 69/36

[52] U.S. Cl. ..... 473/256; 473/349

[58] Field of Search ..... 273/167 F, 169, 273/171, 172, 173, 174, 194 B, 168; 473/219, 226, 228, 231, 256, 282, 291, 324, 330, 340, 327, 341, 349

[56] References Cited

U.S. PATENT DOCUMENTS

| | | | |
|---|---|---|---|
| D. 222,678 | 11/1971 | Dick | 273/168 |
| 786,268 | 4/1905 | Corey et al. | 273/168 |
| 1,334,189 | 3/1920 | Swanson | 273/168 |
| 2,174,212 | 9/1939 | Newsome | 273/169 |
| 2,472,978 | 6/1949 | Mahon | 273/168 |
| 2,998,254 | 8/1961 | Rains et al. | 273/168 |
| 3,397,888 | 8/1968 | Springer et al. | 273/168 |
| 4,461,482 | 7/1984 | Bojicic | 273/168 |
| 4,834,387 | 5/1989 | Waites et al. | 273/169 |
| 4,944,517 | 7/1990 | Redkey | 273/193 R |
| 5,246,231 | 9/1993 | Antonious | 273/169 |

*Primary Examiner*—Mark S. Graham
*Attorney, Agent, or Firm*—Clayton R. Johnson

[57] ABSTRACT

A golf training apparatus constructed in the form of a golf club and having a handle, a shaft and a head wherein the head is constructed to have an elongated rod having one end affixed to the shaft and a flat, blade-like weight affixed to the end portion of the rod opposite the shaft. The weight of the rod and blade-like weight is substantially the same as the weight of a typical golf club head, but the center of mass of the head is displaced from the axis of the shaft by a distance of at least about four inches. The blade-like weigh advantageously is somewhat rectangular in plan view with a narrowed neck portion intermediate its ends or trapezoidal with its minor and major bases extending transverse to the rod.

20 Claims, 4 Drawing Sheets

GOLF TRAINING APPARATUS

BACKGROUND OF THE INVENTION

The present invention relates to a golf training apparatus, and more particularly, the invention relates to a training apparatus generally configured in the form of a golf club but having a unique club head to facilitate the conditioning of a golfer's swing.

It is generally acknowledged that the development of a consistent and repeatable swinging motion of a golf club is perhaps one of the most important factors in enabling a player to improve his proficiency at the game. Golf professionals and golf teaching instructors have, therefore, examined and analyzed practically every conceivable movement which occurs during the swinging motion of a golf club as it is brought into contact with the ball. The golfer's hand grip on the club, the extent and nature of the golfer's backswing, the movement and position changes of the golfer's body during the foreswing, and the golfer's arm and wrist motion during the foreswing are all factors which have been extensively studied and analyzed. In fact, a golfer who is attempting to learn the game is frequently frustrated in attempting to put together all of the suggested motions and positions which together constitute an effective and proficient swinging of the club. Once a basic understanding of the proper club grip, backswing and foreswing has been achieved, it is usually recommended that the beginning golfer simply engage in extended practice sessions in order to train the muscles of the body to become properly coordinated for this purpose. However, even professional golfers will acknowledge that the unintended deviations from the perfect swing frequently creep into the golfer's habits over time, and professional golfers are forced to continuously practice to improve the development of their swing.

Practicing can take the form of actually driving golf balls on the range or merely practicing the swinging motion with a golf club but without the use of a golf ball. Various exercises have also been recommended to improve the conditioning of the important muscles which are used during the course of a golf swing. A number of mechanical training aids have been devised to assist this purpose and such training aids have had varying degrees of success. Frequently, a training aid which is useful for one form of development of the golfer's skills is not useful for another form of development. Therefore, certain training aids have been specialized to deal with only particular and minute increments of skill development.

SUMMARY OF THE INVENTION

The present invention comprises training apparatus for improving muscle development and coordination with respect to the full range of movement involved in a golfer's swing. The invention utilizes a golf club shaft, which is virtually identical to the conventional golf club shaft, attached to a head which is positioned at an angle greater than 90° relative to the shaft. The head is an elongated, weighted member having a center of gravity displaced a considerable distance from the axis of the shaft. The weight of the member has a blade-like configuration and is preferably covered with a plastic material which is heat shrunk over the entire blade-like surface. The materials of the training apparatus are selected so as to yield a total weight for the training apparatus which is substantially equal to the weight of a conventional golf club, but the dimensions and weight of the club may be scaled to match any particular conventional club and may also be scaled for use by children or adults.

Because the, center of mass of the golf head is displaced away from the axis of the shaft, an angular inertia is developed when the club undergoes a swinging motion and the golfer must overcome this angular inertia during the gold swing, thereby developing muscular coordination and strength.

A principal object of the present invention is to provide new and novel golf training apparatus for improving a golfer's swing and developing muscular coordination and strength in the golfer's arms, wrist and hands.

It is another object of the present invention to provide new and novel golf training apparatus having the approximately the same weight as a normal golf club but providing an exaggerated angular momentum during the golf swing.

It is still another object of this invention to provide new and novel means for muscular training and visual training working at the same time to have a synergistic effect to improve the golf swing of a user.

The foregoing and other objects and advantages will become apparent from the following specification and claims, and with reference to the appended drawings.

DESCRIPTION OF THE PREFERRED EMBODIMENT

Figure 10:
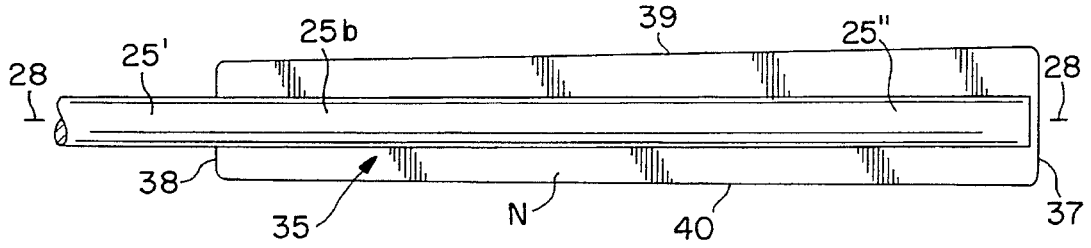
FIG. 10 is a fragmentary plan view of the second embodiment of the head without the plastic coating thereon.
Figure 9:
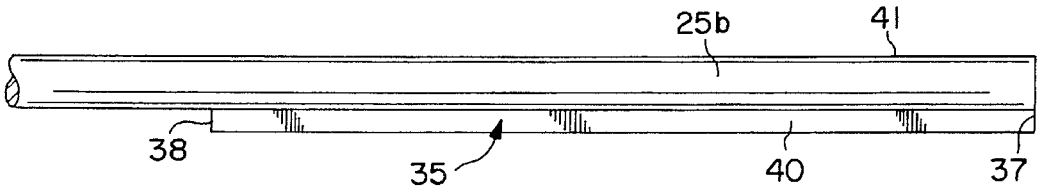
FIG. 9 is a fragmentary side view of the second embodiment of the head without the plastic coating thereon.
Figure 8:
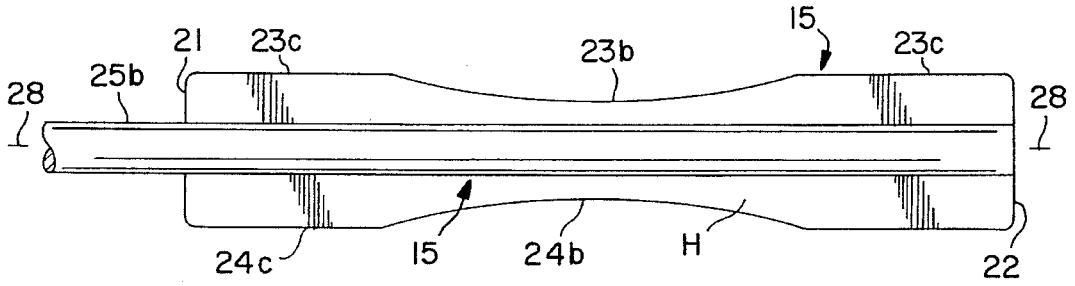
FIG. 8 is a further enlarged fragmentary plan view of the head of FIG. 1 without the plastic coating thereon.
Figure 7:
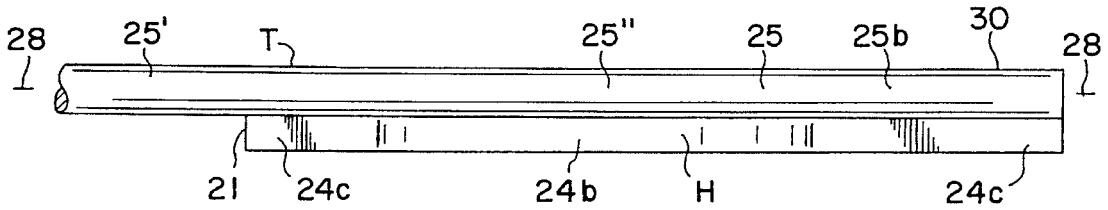
FIG. 7 is a further enlarged fragmentary side view of the head of FIG. 1 without the plastic coating thereon.
Figure 11:
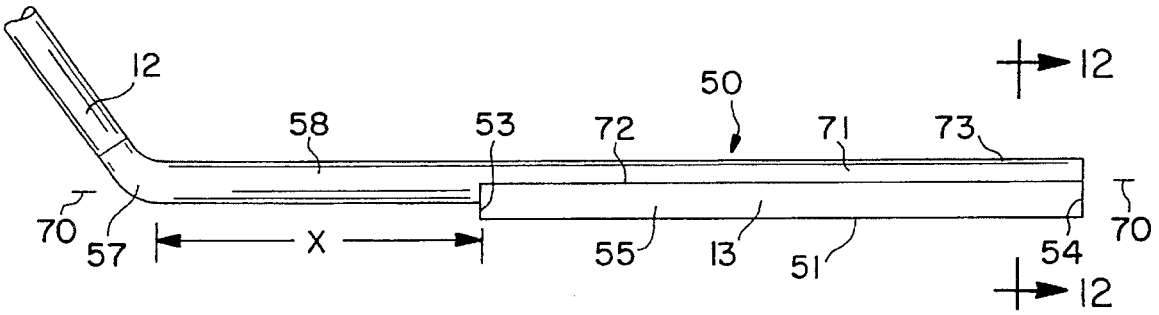
FIG. 11 is a fragmentary side view of the third embodiment of the head without the plastic coating thereon.
Figure 12:
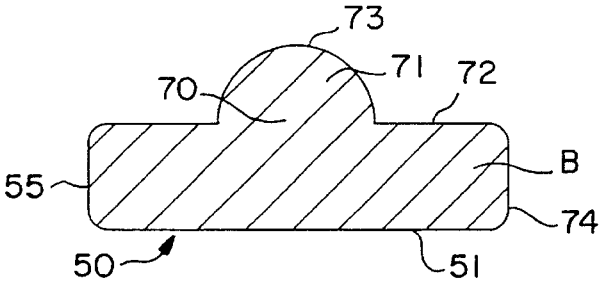
FIG. 12 is a transverse cross sectional view of the head of FIG. 11 that is generally taken along the line and in the direction of the arrows 12—12 of FIG. 11.

The training golf club of the invention includes a shaft 12 that has a handle 14 affixed at one end and a head, generally designated 15 of the first embodiment, affixed at the other end (see FIGS. 1 to 8); or a head, generally designate 35 of the second embodiment, affixed to the other end (see FIGS. 9 and 10) or a head, generally designate 50 of the third embodiment, affixed to the other end (see FIGS. 11 and 12). Shaft 12 may be made from a conventional golf club shaft of either graphite or steel materials. Handle 14 is a conventional golf club grip which may be applied to the shaft 12 in any of the ways which are conventionally known. The head of the respective embodiment is affixed to the lower end of shaft 12 by a welding or brazing process so as to be fixedly positioned relative to the shaft 12 or formed as a single unitary unit with the shaft. The head 15, or 35, or 50 is preferably positioned at an angle A relative to the shaft axis of elongation 18, wherein the head is elongated to have an axis of elongated 28, 28. 70 respectively that extends at an angle A which is greater than 90°. Advantageously, the angle A may be about 117°–130°.

In each of the embodiments, the weight of the training apparatus has been selected to be equal to the weight of a conventional golf "4" or "5" iron, and the angle A has been selected to be same or nearly the same as the angle presented by the lower edge of a "4" or "5" iron relative to the shaft 12. The distance between the handle 14 and the head 15, or 35, or 50 of this invention is chosen to be the same as the corresponding distance between the handle and head for a related standard golf club. For example, if the weight of the head 15, or 35, or 50 is chosen to be the same as a standard golf "5" iron, the distance between handle 14 and head is selected to be the same as the corresponding distance for a standard golf "5" iron, etc.

One of the features of the present invention is to help develop the strength of the wrist and forearm muscles by causing the player to work against the inertia of the head 15, or 35, or 50 during the golf downswing. The inertia of the head 15, or 35, or 50 which must be overcome during the turning motion and downswing is greater than that provided by a normal (conventional) club, because the center of mass of the head 15, or 35, or 50 is further displaced from the axis of the shaft. Therefore, even though the weight of head 15, or 35, or 50 is selected to be identical to the weight of, say, a standard golf "4" or "5" iron, the inertia required to be overcome by the player during the downswing is much greater, for the weight center of mass is spaced considerably farther from the shaft axis as more fully set forth below.

Figure 1:
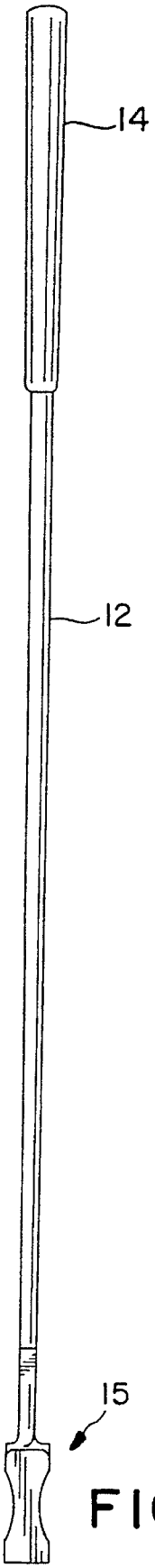
FIG. 1 shows a rear elevation view of the first embodiment of the invention.
Figure 2:
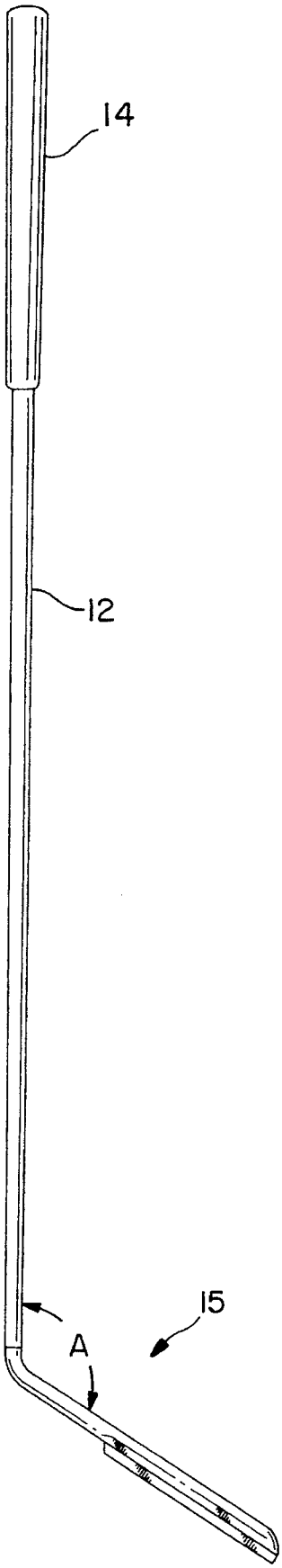
FIG. 2 shows a side elevation view of the first embodiment of the invention.
Figure 3:
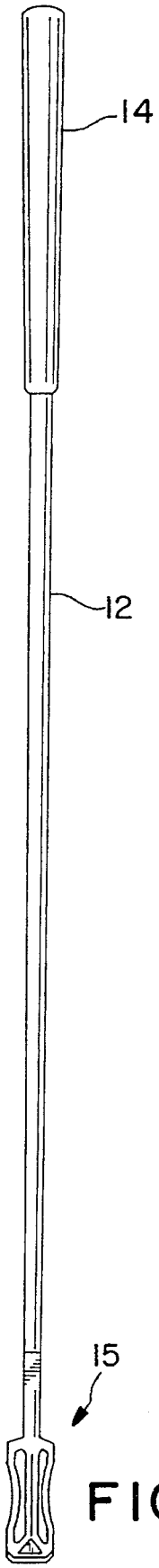
FIG. 3 shows a front elevation view of the first embodiment of the invention.
Figure 4:
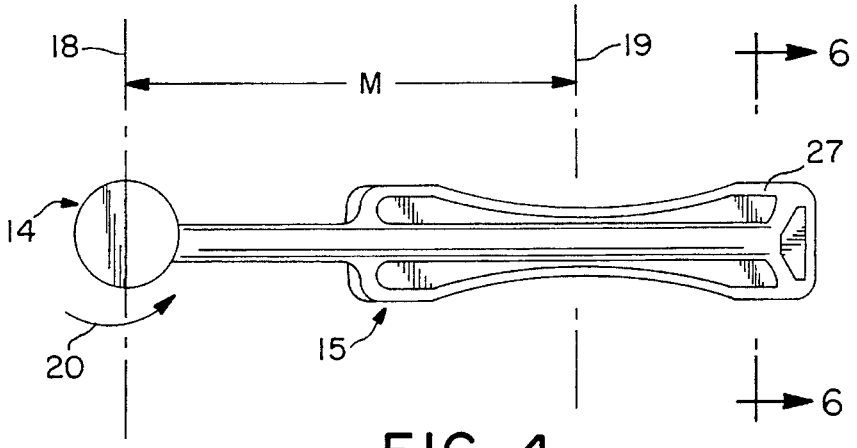
FIG. 4 shows a top view of the first embodiment of the invention with the handle extending 90° to the horizontal.
Figure 6:
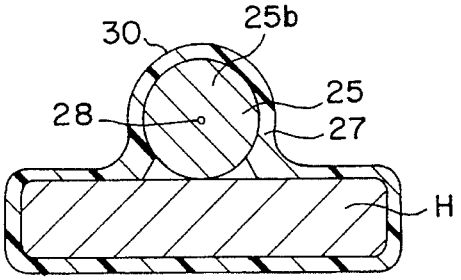
FIG. 6 is an enlarged transverse cross section of the head of FIG. 5 that is taken in a plane perpendicular to the central axis of elongation of the head rod, said view being generally taken along the line and in the direction of the arrows 6—6 of FIG. 5.

FIG. 4 shows a top view of the training apparatus of the first embodiment, taken along the central axis 18 of the handle 14 and shaft 12. The center of mass of head 15 is defined by dotted line 19, and the dimension M denotes the distance between the axis 18 and the center of mass line 19, the dimension M being taken along the central axis 28 of the rod 25 which will be described hereinafter. During the downswing of the training device, or of any golf club, the player turns the club about the shaft axis in the direction indicated by arrow 20. This turning motion is accomplished by rotation of the player's wrists as the player swings the club downwardly, with the object being to rotate the club axis so that the club head is perpendicular to the player's body at the instant of impact of the club head against the golf ball. This turning motion accelerates the motion of the club head just prior to the point of impact, and creates the maximum momentum of the club head which may be transferred to the ball at the instant of impact, and thereby creates the longest possible drive of the ball. The turning motion required by the use of the wrist and forearm muscles will enhance the player's ability to deliver a strong impact to the ball.

Figure 5:
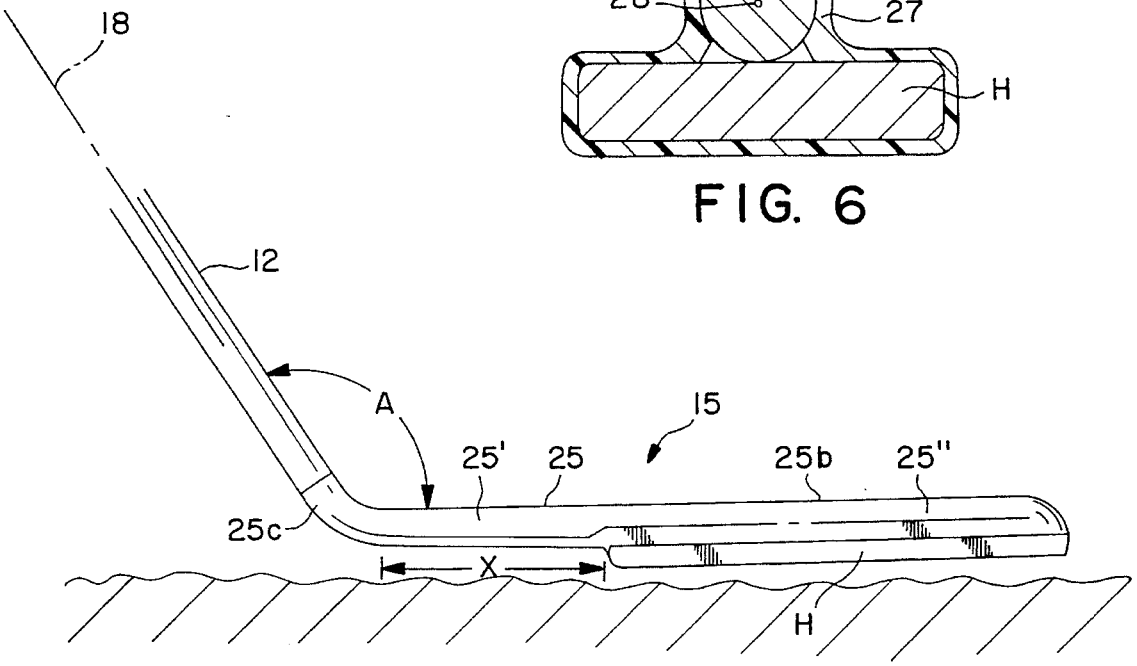
FIG. 5 shows an enlarged partial side elevation view of the first embodiment of the invention in alignment with the ground, the plastic covering not being shown.

FIG. 5 shows the position of the training apparatus of the first embodiment 15 relative to the ground, at a position which corresponds to the point of impact of a club against a golf ball. It is apparent that other than the bent portion 25*c*, the head 15 is parallel to the ground at this point, spaced at or slightly above ground level. Although the head may be cast or otherwise formed as one integral unitary single piece, advantageously the head 15 is formed of three components: a rod 25 bent at an angle A and has its bent portion 25*c* affixed to the bottom of a shaft 12, a blade or bar H welded to rod 25, preferably in the position shown so that the bottom surface of the blade H passes very close to the surface of the ground during the swing and an outer protective plastic covering or coating 27. The outer plastic covering 27 is applied over the rod 25 and blade H for protective purposes, and to provide an aesthetic enhancement to the appearance of the apparatus. Plastic covering 27 may be formed from heat shrink plastic or from any other convenient coating material which provides the desired effect. The top surface of the blade H is welded or otherwise suitably joined to rod 25 proximate the end of rod 25 which is furthest from the shaft 12 while its bottom surface is advantageously flat. The blade (bar) may be of a somewhat rectangular block shape, other than side cutouts, and elongated in the direction of elongation of the rod portion 25*b* which extends away from the bent (turned) portion 25*c* that is joined to the shaft. The bar or blade H is elongated in the same direction as the direction of elongation of the rod portion 25*b* which extends away from the bent (turned) portions 25*c* that is joined to the shaft. The blade H has front and rear sides 23 and 24 respective that are arcuately curved at 23*b*, 24*b* respectively, for example elliptically or circumferentially about radii much greater than the width of the bar, but much less than the length of the bar. Advantageously, the points of emanation of the points of curvature are in a plane(s) perpendicular to the axis 28 of elongation of the rod and equally spaced from and on opposite sides of the axis 28. Further, it is desirable that the dimension of each cutout parallel to the axis 28 is substantially greater than the combine dimensions of the side edge linear portions 23*c*, 24*c* on the respective side of the blade. As a result, in plan view, the blade H has a narrow neck portion intermediate its distal and proximal edges 22 and 21 respectively with linear side edge portions 23*c*, 24*c* respective extending between respective arcuate portion and the adjacent proximal and distal edges and, in plan view, desirably is substantially transversely centered relative to the central axis of rod portion 25*b*. Advantageously, the length of the blade is many time greater than its maximum width while the minimum width may be about 80 per cent or less of the maximum width. Additionally as may be seen from FIG. 5, rod portion 25*b* has a cylindrical part 25' that spaces the proximal edge of the blade H from the bent portion 25*c* a substantial longitudinal distance (distance x in FIG. 5). The top part 25" of rod portion 25 is joined to cylindrical part 25' to extend more remote therefrom and may or may not extend to the distal edge 22. The blade H is dependingly joined to the top part 25".

As an example of one preferred embodiment, the training apparatus is made to correspond to a normal golf "5" iron, other than for the head, the head of a normal golf "5" iron being of a weight being approximately 280 grams. Advantageously, the weight of the head for a "5" iron invention is about 275–285 grams and desirably approximately 280 grams. Thus, the head of this invention may have a blade that weighs about 215 grams and a rod 25 of about 65 grams. The length of the blade H advantageously may be about 4½–6½ inches and desirably about 5½ inches, while the length of the rod 25 advantageously is about 8–10 inches and desirably about 9¼ inches and the dimension x may be about 3 to 3 ¾". The center of mass of the head along rod axis (head central axis of elongation) 28, of the elongated part 25*b* of the rod which extend away from the rod bend 28*c*, is, therefore, approximately 4–6 inches along the axis 28 from the axis 18 of the shaft 12 and desirably about 5 inches but below the axis 28. By comparison, a standard (conventional) "5" iron, which has the same total weight, has a center of mass spaced less than 2 inches from the axis of the shaft. The axes 18, 28 and 70 of the embodiments of this invention are preferably contained in a single plane for the respective embodiment while the center of mass is located in said plane, but below the respective axis 28, 28 70. It is therefore, apparent that due to the provision of the heads 15, 35, 50 the invention greatly increases the rotational inertia of the head about the shaft axis when compared with a standard golf club of the same weight. It is preferred that in plan view, each of the heads is symmetrical relative to the plane referred to in this paragraph.

According to the teachings of the invention, it is desirable that the center of the mass of the head 15, or head 35, or head 50 in the direction of elongation of rod portion 25*b* and rod parts 58, 71 be displaced at least about four inches from the axis of the shaft 12 and preferably about 4–6 inches. It is also desirable that the weight of the blade H be at least about three to four time the weight of the rod 25, in order to obtain the desired inertial resistance during a golf swing. The weight distribution of the blade can be uniform along its length or can be nonuniform, so long as the center of mass is displaced as described. The length of the blade H, when positioned at the distal end of the rod 25, should be about ½ to ⅔ the length of the rod 25 in order to provide the necessary inertial resistance; and of course, it is desirable that the total weight of both the rod 25 and the blade H be substantially equal to the weight of a normal golf club head.

As one example of blade H, but not otherwise as a limitation thereon, the length of the blade may be 5½", edge portions 23*c*, 23*c*, 24*c*, 24*c* may each be about 1 to 1¼" and the cutouts arcuately curved to have a minimum neck dimension of ¾" and the distal and proximal edges each of 1", and a thickness of 3/16"; however, it is to be understood these dimensions can be varied to fall within the parameters set forth herein.

A further feature of the invention which assists in training a golfer's swing is the configuration of the head. The rod 25 and blade H are elongated and aligned at the angle A relative to the shaft 12, with the object of training the golfer to swing so as to position the blade horizontal to the ground at the point of impact with a golf ball. The shape and configuration of the head 15 provides a ready visual indicator of its position, and the golfer can immediately see if he is swinging properly to provide the preferred head position at the point of impact. If the golfer tends to swing too close to the ball or too far from the ball, the blade B, or H, or N, will provide an obvious visual indication of this problem each time the golfer makes a practice swing, and the golfer can adjust his stance to make certain that the blade H passes over the ground in a parallel relationship during each downswing.

Referring to Figures nine and ten, the second embodiment of the head 35 includes a rod 25 and protective coating such as describe with the head 15 together with-a bar or blade N, which also may be referred to head bottom portion. The top surface of the blade N, which advantageously is substantially flat, is welded or otherwise suitably joined to rod top part 25" proximate the end of rod 25 which is furthest from the shaft 12 while the blade has a generally flat bottom surface. The blade (bar) may be of a generally isosceles trapezoidal block shape that has its major base 37 remote from the shaft 12 and a minor base 38 adjacent to, but substantially spaced from the rod bent portion 25*c*, and is elongated in the direction of elongation of the rod portion 25*b*. The bar or blade N is elongated in the same direction as the direction of elongation of the rod portion 25*b* which extends away from the bent (turned) portions 25*c* and in plan view is desirably substantially transversely centered relative to the central axis 28 of rod portion 25*b*. The blade N has front and rear sides 39 and 40. Advantageously the length of the blade is many time greater than its maximum width while the minor base is of a dimension greater than the diameter of the rod portion 25*b*. Further, the center of mass of the head 35 is located relative to the shaft axis such as described relative to head 15 and the length and location of the blade N relative to the rod may be about the same as that indicated for blade H. With the second embodiment, the rod may be shorter than that of the first embodiment in that the major base of the blade is furthest from the shaft.

As one example of the blade N, the perpendicular spacing of the minor and major bases may be 5½", the minor base ¾", the major base 1" and the thickness about ⅛"; however, it is to be understood the dimensions may be varied, for example the minor base narrower and/or the major base wider, as long as the center of mass is maintained in the desired relationship to the shaft axis as set forth herein. Further, the diameter of the cylindrical part 25' for each of the first and second embodiments may be about 5/16" but again may be varied as long as the center of mass is retained in the desired relationship to the shaft axis as set forth herein.

Referring to FIGS.11 and 12, the third embodiment of the head of the invention, generally designated 50, includes a rod T having a bent portion 57 joined to the lower end of a shaft 12 and a cylindrical part 58 having a proximal end joined to the bent portion, and a top part 71 that at its proximal end is joined to the distal end of the cylindrical part. A blade or bottom portion B is joined to the top part 71 in transversely centered relationship. The bottom portion in plan view may be rectangular or either one of the shapes shown in plan view in FIGS. 8 and 10. Advantageously, the bottom portion is substantially rectangular in transverse cross section and has a flat bottom 51 and front and rear side edges 74, 55 respectively. The longitudinal length of the top part 71 may be the same as that of the bottom portion and extend transversely approximately through an arc of 180 degrees with a radius of curvature emanating from an axis 70 that constitutes a straight line extension of the central axis of the cylindrical portion 58. The axis of elongation 70 of the elongated portion of the rod that extends away from bent portion 57 advantageously is located in the plane of the top surface 72 of the bottom portion B. Further, it is desirable that the distal end of cylindrical part 58 is integrally joined to proximal end 53 of the bottom portion as a single unitary unit while the top portion is likewise integrally joined to the bottom portion B. The blade B has a distal edge 54 and an opposite edge 53. The length and diameter of cylindrical part 58 may be the same as that of part 25' of the first embodiment.

The center of mass and weight of the head of the third embodiment is within the parameters set forth relative the first and second embodiments.

With reference to the rod of each of the embodiments in transverse cross section is arcuately curved along, at least, substantially its entire length that is most remote from the blade is located in the plane of the shaft axis and the central axis of the longitudinally elongated rod portion 25*b* of the first and second embodiments and axis 70 together with the generally flat top surface of the respective blade provides a line of sight 30, 41, 73 for the first, second and third embodiment respectively that serves as a visual aid during the use of the club. Even through the line of sight in some of the Figures is shown at the top of the rod elongated portion, it is to be understood it would be at the top of the coating 27 if provided on the respective embodiment. That is, there is provided a visual line, not necessarily a mark or a line formed on the top of the arcuate surface, at the top of the elongated rod portion. With the heads of this invention, the combination of the line of sight and the location of the center of mass, there is developed better coordination between the eyes and muscles of the user.

Advantageously, for each embodiment, the angle A is about 117 to 130 degrees, the central of mass is about 4 to 6 inches from the shaft axis and the weight of the head would be about 265 to 285 grams. Further, the head of each embodiment has a longitudinally elongated top portion (part) that is transversely arcuately curved through an angle more than 130 degrees for at least a major portion of its length.

It is believed the use of the second and third embodiments is apparent from the more detailed description set forth relative the first embodiment. advantageous that the dimension of the spacing of the proximal edge of the blade from the bent portion (length of the rod cylindrical portion—shown as X in FIG. 5) is at least 2½ inches or more, depending on the weight of the blade relative to the rod.

It is to be understood the shape of the head may be varies as long as the center of mass, length and the shape of the bottom of the head are generally the same as that of head 15, or 35, or 50, and functions the same as the rod, blade and coating described herein.

The foregoing preferred embodiment provides the best mode presently known for exemplifying the inventive principles describe herein, although other constructions may well be possible within the scope of the claims presented herewith.

What is claimed is:

1. Golf training apparatus comprising an elongated shaft having an upper end and a lower end and extending along a straight axis, a handle grip affixed at the upper end and an longitudinal elongated head affixed to said lower end and having a longitudinal axis of elongation extending away from the shaft, said head having a predetermined mass aligned along the head axis, said head axis being aligned at an angle of greater than 90° relative to the shaft axis, and said mass having a center of mass displaced from said shaft axis at a distance of at least about four inches, the weight of the head being about 265 to 285 grams.

2. The apparatus of claim 1, wherein said angle is about 117 to 130 degrees.

3. The apparatus of claim 1, wherein the head includes an elongated rod portion having a central axis of elongation and the blade in plan view, is substantially transversely centered to the elongated rod portion axis.

4. The apparatus of claim 1 wherein the head includes a rod portion having a bent part joined to the shaft lower end and an elongated rod part having proximal end joined to the bent part to extend away from the bent part at said shaft axis, said elongated rod part having a central axis extending away from the shaft axis at said angle.

5. The apparatus of claim 4, wherein the blade is of a generally rectangular in plan view and has distal and proximal edges and side edges extending between the distal and proximal edges, said side edges having side edge portions that are arcuately curved intermediate the distal and proximal edges and on opposite sides of the head axis to provide a narrow neck portion longitudinally intermediate the distal and proximal edges.

6. The apparatus of claim 4, wherein the head includes a blade that is elongated in the direction of elongation of said elongated part and joined to the elongated rod part to extend therebeneath remote from the bent part.

7. The apparatus of claim 6, wherein the blade is generally trapezoidal in plan view and has distal and proximal edge portions and side edges extending between the distal and proximal edge portions.

8. The apparatus of claim 7, wherein the blade has a distal major base remote from the rod bent portion and an opposite minor base edge and the trapezoidal shape is generally that of an isosceles trapezoid.

9. The apparatus of claim 7, wherein, in plan view, the blade is substantially transversely centered relative to the elongated rod portion axis and the transverse dimension of the proximal end portion is greater than the diameter of the elongated rod portion.

10. Golf training apparatus comprising an elongated shaft having an upper end and a lower end and extending along a straight axis, a handle grip affixed at the upper end and an longitudinal elongated head affixed to said lower end, said head having a bent portion joined to the shaft lower end, a longitudinally elongated cylindrical part having a proximal end and a distal end joined to the bent portion to extend away therefrom, a longitudinally elongated top part that is transversely arcuately curved angularly through an angle more than 130 degrees for at least a major portion of its length, said top part having a proximal end joined to the cylindrical part distal end and a terminal distal end, said cylindrical part and top part having a coextensive central axis of elongation that extends at an angle greater than 90° relative to the shaft axis, and a longitudinally elongated bottom bar portion joined to the top part to extend below and adjacent to the cylindrical part and to extend at least the length of the top part, the bottom portion having a generally flat bottom surface and being substantially transversely centered relative to the top part, the bottom portion being of a minimum transverse dimension that is substantially greater than a minimum transverse dimension of the top part.

11. The apparatus of claim 13, wherein the head has a center of mass that is displaced from the shaft axis by at least 4 inches and is located in said common plane.

12. The apparatus of claim 10, wherein the top part is substantially semi-circular in transverse cross section and the bottom portion has generally planar surfaces on each transverse side of the top portion that are generally parallel to the bottom surface.

13. The apparatus of claim 10, wherein the shaft has a shaft axis of elongation, the shaft axis and the coextensive axis being in a common plane.

14. The apparatus of claim 13, wherein the head has a center of mass that is displaced from the shaft axis by at least 4 inches and is located in said common plane.

15. The apparatus of claim 13, wherein the bottom portion in plan view has distal and proximal edges that extend at about right angles to said common plane and front and rear edges that are arcuately curved intermediate the distal and proximal edges to provide a narrowed neck portion intermediate the distal and proximal edges.

16. The apparatus of claim 13, wherein head has a predetermined mass which has a center of mass in said common plane and is spaced from the shaft axis by a distance of at least four inches.

17. The apparatus of claim 10, wherein the combination of the top portion, the cylindrical portion, the bent part and the top part constitute a rod, said top part in transverse cross section being arcuately curved to extend through 360 degrees.

18. The apparatus of claim 17, wherein said bottom portion is substantially trapezoidal in plan view.

19. The apparatus of claim 17, wherein said bottom portion has a longitudinally Intermediate portion that in transverse cross section is of a substantially narrower width than the width of each of its distal and proximal ends.

20. A golf training club having shaft having an upper end and a lower end, and a head having an elongated head portion that has an axis of elongation and a bend portion joining the head elongated portion to the shaft lower end to extend at an angle to the shaft of about 117 to 130 degrees, the head portion having a center of mass about 4 to 6 inches from the shaft lower end and being of a length of about 8 to 10¼ inches, a weight of about 265 to 285 grams and extending at about 117 to 130 degrees relative to the shaft.

* * * * *